United States Patent [19]

Smit et al.

[11] Patent Number: 4,551,860

[45] Date of Patent: Nov. 12, 1985

[54] METAL MESH HEAD COVERING

[76] Inventors: Helen E. Smit; Julie A. Smit, both of 1045 Hinman Ave., Evanston, Ill. 60202

[21] Appl. No.: 353,840

[22] Filed: Mar. 1, 1982

[51] Int. Cl.[4] ..... A42B 1/18

[52] U.S. Cl. ..... 2/175

[58] Field of Search ..... 2/195, 200, 175, 197

[56] References Cited

U.S. PATENT DOCUMENTS

| | | | |
|---|---|---|---|
| 1,150,400 | 7/1914 | Burke | 2/195 |
| 1,614,231 | 1/1927 | Cosgrove | 2/195 |
| 1,624,727 | 4/1927 | Goldberg | 2/197 |
| 1,704,576 | 3/1929 | Pellegrino | 2/197 |
| 2,749,555 | 6/1956 | Oliveira | 2/175 |
| 3,041,628 | 7/1962 | Fish et al. | 2/200 |
| 3,766,565 | 10/1973 | Cozzens | 2/200 |

*Primary Examiner*—Doris L. Troutman

*Attorney, Agent, or Firm*—Laff, Whitesel, Conte & Saret

[57] ABSTRACT

A hat or cap has a crown, and possibly also a brim or visor, which is made of a decoratively rigid or semi-rigid material, such as metal or plastic. The airy, mesh-type head covering enables air to circulate within the hat while still enabling a stylish coiffure to be fully visible while the hat is being worn.

1 Claim, 8 Drawing Figures

METAL MESH HEAD COVERING

This invention relates to head coverings and more particularly to head coverings which keep the head cool and well ventilated in warm and hot weather while still enabling a person to be both stylish and protected from excessive wind and sun.

There are many times when a head covering is desired to keep a person's hair in place, such as on a hot, windy day. Many people go out on a windy day and have the annoyance of having their hair continuously blowing in their faces and eyes. Yet, on a hot day, these people do not wish to wear a conventional, confining, and restricting hat which is both hot and uncomfortable. The conventional hat made of a solid material which may cause the head to become overheated in warm weather because it is not well ventilated. Another problem with conventional hats made of a solid material is that they are too easily blown off the head, on a windy day.

An alternative is to wear a ventilated hat which is made of loosely woven straw or threads, plastic netting, or the like. Each of these hats has its own set of problems. If the ventilating openings are small enough, air does not circulate, the wind may catch it, and blow off the hat. If the weather is hot enough, there may be perspiration which discolors and soils the hat, and which gives the hair a "plastered down" look. Also, a person who has a styled coiffure wishes to both display it and protect it from the wind and perspiration. The usual ventilated hat cannot accomplish any of these ends.

Accordingly, an object of this invention is to provide new, improved, and stylish hats and caps which will keep a person's head cool and well ventilated in warm and hot weather.

Another object of the invention is to keep a person's hair in place on a warm, windy day. Here, an object is to provide a hat or cap that is not easily blown off the head, by the wind. In particular, an object is to protect a coiffure without placing any substantial weight directly on the hair.

Yet another object of the invention is to provide stylish and airy hats which may be worn comfortably either indoors or outdoors, as a fashion accessory.

Still another object of the invention is to provide hats and caps which are made of a material, such as wire, plastic or other easy care materials, which may be either washed with soap and water or simply rinsed off with clean water.

A further object of the invention is to provide decorative, well ventilated head coverings with many spaced apart openings to enable air and sunlight to reach head, hair, and scalp.

Yet another object of the invention is to provide hats and caps which may be decorated in new and novel ways, such as by snapping dangling ornamental charms or buttons onto wires in a grating, by weaving chains, ribbons, a string of beads, or the like, through the grating, or by tying bows onto desired wires, etc. The term "charm" is used herein to mean the kind of a small ornament which is usually worn on a bracelet or a chain.

A still further object of the invention is to provide hats and caps wherein a hairstyle is fully visible, while the hat is being worn.

In keeping with an aspect of the invention, a hat or cap is made of a metal mesh. The entire crown and possibly also the brim or visor is made of a decorative, grated, rigid or semi-rigid material, such as metal or plastic. In several embodiments, the hat material may be made from expanded metal, woven screen, or a twisted wire net (which may collectively be called a "mesh-type of open wire fabric"). In the woven or twisted wire, it may be desirable to dip the finished hat in a molten metal bath to integrate all wires and to give a smooth surface without clogging the openings. The airy, mesh-type head covering preferably has at least an approximately equal ratio of opening area space to solid material, thus enabling air to circulate within the hat in order to keep the head cool and well ventilated in warm and hot weather. The decoratively, grated hat or cap comfortably protects a coiffure on a warm, windy day and there is little or no chance that the hat will be blown off the head.

The preferred embodiments of the invention may become more apparent from the attached drawings, wherein.

Figure 1:
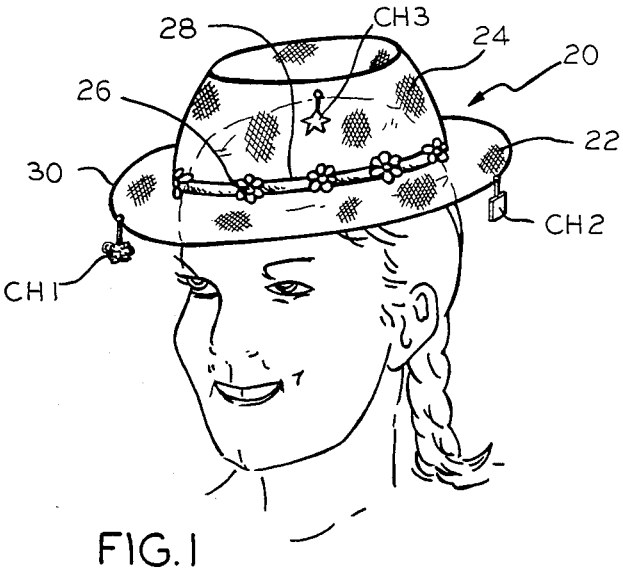
FIG. 1 is a pictorial representation of a woman wearing a small brim, coiffure protecting hat, wherein the grated material is formed into diamond patterns.

FIG. 1 shows a woman wearing a small brim hat 20 made of a grated metal material forming a somewhat diamond pattern of woven wire, as seen at 22, for example. The total area of all of the openings 24 should enable plenty of air to flow into and out of hat 20 to ventilate the head while still keeping the coiffure in place, even on a very windy day. Hat 20 will not be blown off the head, in even high wind, because there is very little solid material for the wind to work against and because the weight of the hat is substantial as compared to the area of the hat which catches and reacts to the wind. Furthermore, the entire head and hair are fully visible through hat 20, which enables a coiffure to be seen, while preserving the sought after, outdoor look which comes with wearing no hat.

Flowers or other decorative trim 26 may be positioned around the hat band 28 to add decoration to hat 20. As here shown, a number of charms CH1–CH3 may be hung from the hat, wherever desired. The edge 30 of the brim may be finished off with any suitable material and design, as explained below in connection with FIGS. 5–8.

Figure 2:
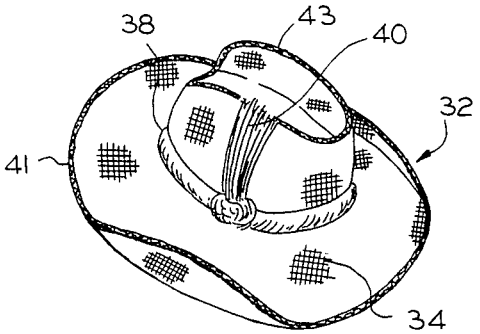
FIG. 2 shows a currently popular cowboy style hat wherein the grated material is formed into squares.

FIG. 2 shows a cowboy hat 32 in which the grated material forms squares and square space openings 34. A conventional band 38 and feather 40 may be used to retain the hat size and shape and to add decoration. The edges 41 of the brim and any seams 43 are covered with a fabric braid, which gives a finished "look" to the hat.

Currently, a cowboy hat is a very popular style which is worn by many young people, both indoors and outdoors, as at discos, bars, and sporting events. After a few hours of wearing a conventional solid material cowboy hat indoors, as while dancing, the head begins to perspire. The hair tends to become matted so that the conventional solid material hat cannot thereafter be removed. Since the mesh cowboy hat 32 of FIG. 2 can be worn comfortably inside and since it is well ventilated, the head does not become overheated, even when the hat is worn for extended periods of time, while the wearer is quite active. Therefore, when the metal mesh hat is removed, the hair remains in the same condition that it was in when the hat was first put on. This is especially important with the so-called "dry" look. When worn outdoors, the hat is cool, and the wide brim shields much of the sun's rays from the wearer's heads and faces, while allowing sunlight to filter through. When part or all of the brim is made of a louvered material, it is easy to block the passage of light while enabling an easy flow of air. An example of such louvered material is often found in the rear window of an automobile.

Preferably, the mesh is made of a metal or plastic material, which can be easily rinsed with either water alone or with soap and water, to clean off dirt and dust, etc.

Figure 3:
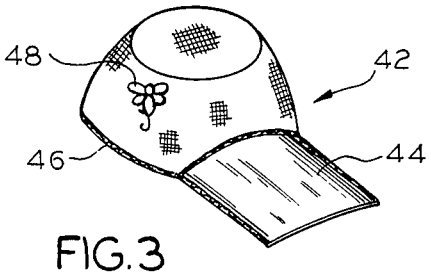
FIG. 3 shows a cap made of grated metal with a solid visor, to keep the sun off a person's face.

FIG. 3 shows a mesh cap 42 with a solid visor 44, that shields and reflects much of the sun's rays from a person's face and eyes. Of course, the visor could also be made of a mesh or louvered material, to enable a free flow of air with no or some sunlight filtering through. Cap 42 is exemplary of a hat for the beach. When it is laid down in the sand, it will not blow away. Also, any sand may be rinsed off by dunking the cap in the lake, ocean, etc. Cap 42 is herein shown as being decorated with a chaining 46 woven through the openings in the mesh at the bottom of the cap. Fishermen and boaters might use their mesh caps to carry lures, sinkers, emblems, buttons, etc., as shown at 48, by way of example.

Figure 4:
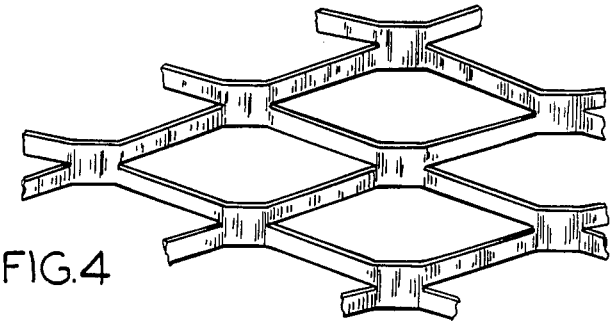
FIG. 4 shows, in perspective, a small fragment of expanded metal which may be used to make the hats.

FIGS. 4–8 illustrate different forms of a mesh which may be used to make the hat. For example, FIG. 4 shows mesh which is expanded metal, preferably aluminum, and which may or may not be anodized to have any suitable color. Currently, a number of different expanded metals are available, which make excellent hat material. For example, some expanded metal strips are sold for use as screens to cover gutters at the eaves of a roof, in order to keep leaves out of the roof drainage system. Other forms of expanded metal are sold for inserts into doors and screens. Still, other expanded metal may be found in hardware and specialty stores. Much of this expanded metal is made from metal sheets and have a thickness which is not too much thicker than a very heavy grade of aluminum foil.

Figure 5:
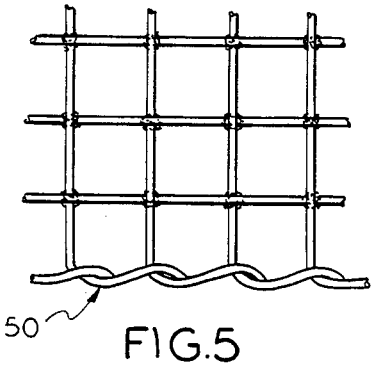
FIG. 5 is a small fragment of woven wire, with a finished edge, which has been dipped in a molten metal bath.

FIG. 5 shows a woven wire mesh or screen which is preferably first shaped into a hat. Then, free wire ends at the raw edges of the screen or mesh are laced together, as shown at 50. Then, it is preferable for the entire hat to be dipped into a molten metal bath to form the wires into an integrated mass.

Figure 6:
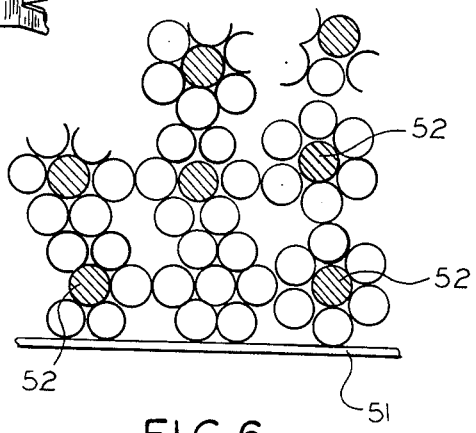
FIG. 6 is a small fragment of stamped metal having any suitable design formed therein.

In FIG. 6, the mesh is stamped from a sheet of metal, which means that the openings and the material around the openings may be made in any suited form, limited only by a designers imagination. Since the entire pattern is stamped from the metal, an edge member 51 may be formed as a continuous metal ribbon for giving a finished edge or hat band which does not stretch. Selected openings in the mesh may have any suitable stones (shown by cross hatching 52) set therein. For example, these stones could be plastic jewels, polished cabochons, imitation flowers, or the like.

Figure 8:
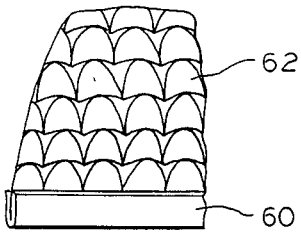
FIG. 8 shows an alternative mesh pattern, by way of a non-limiting example of any arbitrary design.

By way of further example, FIG. 8 shows another stamped design, which is somewhat suggestive of scales 62.

Figure 7:
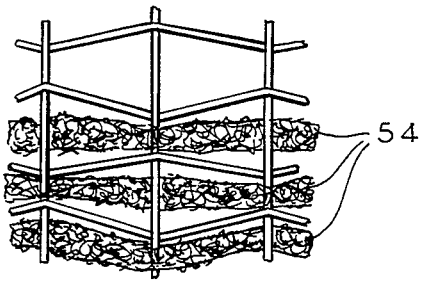
FIG. 7 is a small fragment of woven wire with a fabric or similar material woven into the wire.

In FIG. 7, the mesh is shown as having a string of beads, ribbons, a suitable fabric, or chain 54 woven therein. This weaving may finish the bottom of the hat, as shown at 46 (FIG. 3) or provide a hat band, as shown at 38 (FIG. 2).

The advantages of the invention should now be apparent. A metal mesh, pill box style of hat is ideal for a woman who has a fancy, bouffant hairstyle, since the crown of the hat does not rest against the top of the head, and therefore, does not "mash down" the hairstyle. Furthermore, a woman has her hair styled, and then she does not have to conceal it under a solid hat. Still, she has a hat to keep her hair from becoming wind-blown when she is outside. The ventilated, mesh hats are more stylish than alternatives for hair control, such as hair nets, plastic wind bonnets, scarves, and the like. The mesh hats and caps enable a new and novel approach to hat decoration, which cannot be done with conventional solid material hats.

Furthermore, the mesh of the hats and caps can be made in many different, decorative patterns and designs. Further possibilities provide for scroll effects, heart and star designs, etc. Also, the hats and caps could be formed of a mesh with opening spaces, which are smaller and more numerous in order to reduce the amount of sunlight coming through the hat and to afford more protection from the sun. The mesh-type hats and caps may be made of one or several pieces of material depending upon whether they are formed in one piece, as by molding and pressing them into shape, or by piecing and soldering or heating the sections together. The outer edges of the hats and caps may be finished, as shown in FIGS. 5–8, in any suitable manner. For example, a strip 60 (FIG. 8), having a pressure sensitive adhesive on one side, may be folded over the edges of the metal mesh and pressed into place, adhering to itself. The edges may also be formed by simply doubling the mesh material over several times, thus forming a roll around the outer edges. Also, the inventive mesh-type hats and caps can be made in any of many different styles, other than the exemplary three styles seen in FIGS. 1–3.

Those who are skilled in the art will readily perceive how to modify the invention. Therefore, the appended claims are to be construed to cover all equivalent structures which fall within the true scope and spirit of the invention.

We claim:

1. A process for making a single layer headcovering comprising the steps of:

a. molding a single piece of a mesh-type of open metal wire or plastic wire fabric material in the form of a desired seamless crown which is fully self-supporting, said crown having a size and a shape which fits around the perimeter of, rests lightly on and is fully supported on the wear's coiffure, whereby said crown does not squeeze a hair style, the crown enclosing and protecting a fluffy, curly hair style from becoming wind blown while ventilating a head to enable air to pass freely through the crown, said open fabric giving an unencumbered view of said hair style;

b. finishing the peripheral edges of said mesh-type material around the open edge of the crown in a hat band region of said crown, said finished edge closing raw ends of said wire fiber so that said mesh will not catch in a person's hair;

c. incorporating a brim or visor onto said crown at said hat band region of said hat band;

d. coloring the mesh-type material any color; and e. adding a hat band to completely surround and contain said molded mesh crown to preserve a fixed and non-varying periphery for said crown.

* * * * *